United States Patent [19]

Eifler

[11] 4,406,507

[45] Sep. 27, 1983

[54] ELECTRICAL CONNECTOR INSERT

[75] Inventor: Raymond J. Eifler, West Bloomfield, Mich.

[73] Assignee: The Bendix Corporation, Southfield, Mich.

[21] Appl. No.: 279,271

[22] Filed: Jun. 30, 1981

[51] Int. Cl.[3] ..... H01R 13/42
[52] U.S. Cl. ..... 339/59 R
[58] Field of Search ..... 339/59 R, 59 M, 217 S

[56] References Cited

U.S. PATENT DOCUMENTS

| | | | |
|---|---|---|---|
| 3,101,229 | 8/1963 | Yopp | 339/217 X |
| 3,158,424 | 11/1964 | Bowen . | |
| 3,165,369 | 1/1965 | Maston . | |
| 3,221,292 | 11/1965 | Swanson et al. . | |
| 3,390,376 | 6/1968 | Naua | 339/217 S |
| 3,747,047 | 7/1973 | Carter et al. | 339/91 R X |
| 3,812,447 | 5/1974 | Eifler et al. | 339/217 R X |
| 3,824,681 | 7/1974 | Clark | 339/90 C X |
| 4,082,398 | 4/1978 | Bourdon et al. | 339/59 M |

FOREIGN PATENT DOCUMENTS

| | | | |
|---|---|---|---|
| 2337949 | 8/1977 | France | 339/59 M |

*Primary Examiner*—Mark Rosenbaum
*Attorney, Agent, or Firm*—Raymond J. Eifler

[57] ABSTRACT

An electrical connector insert that permits front or rear release of the contact within the connector and rear removal of a contact. The invention relates to connectors and more particularly to an electrical connector insert within the connector that retains electrical contacts (50) having an annular groove therein (51) and a plurality of resiliently and radially expandable tubular contact retention towers (15) each having an internal annular shoulders (18) therein that engage the annular groove (51) in a respective contact (50). Surfaces (16 and 17) on opposite sides of said shoulder (18) taper radially outwardly away from said shoulder, and are adapted to receive an appropriate tool from the rear or the front of the tower (15) to radially expand the tower (15) whereby a contact (50) is released from either the front or rear of the tower (15) for removal from the tower.

4 Claims, 7 Drawing Figures

FIG. 1
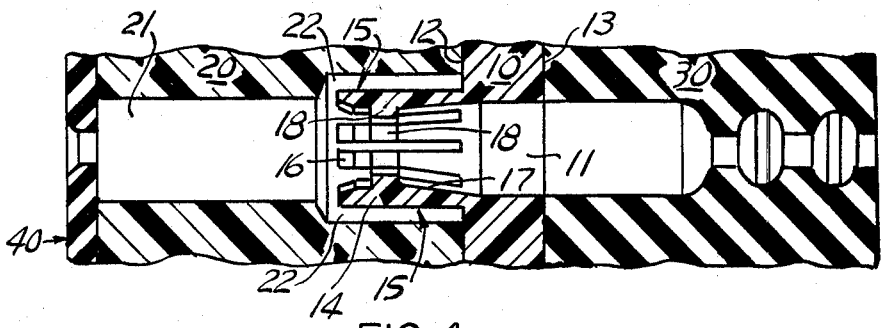
FIG. 4
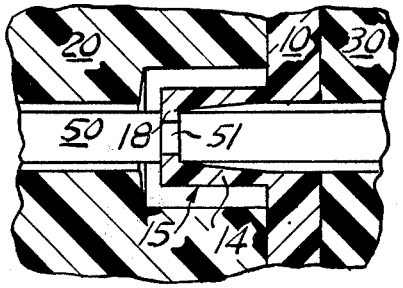
FIG. 2
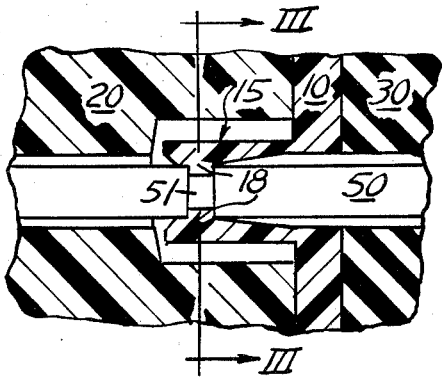
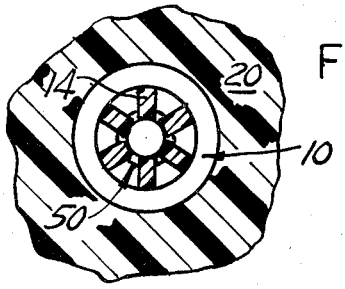
FIG. 3

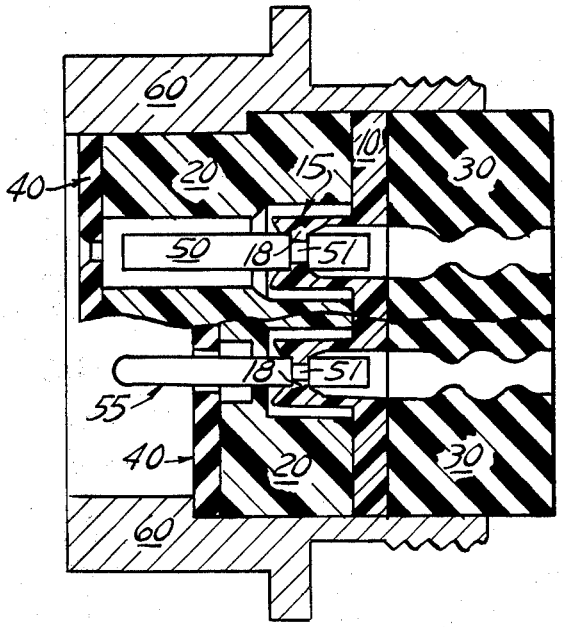
FIG. 5
FIG. 6
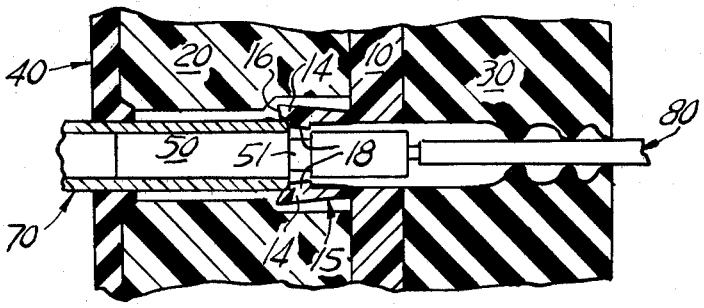
FIG. 7
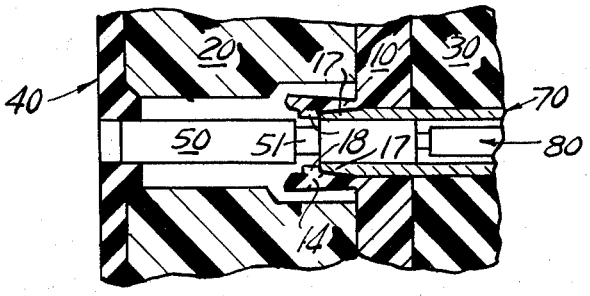

ELECTRICAL CONNECTOR INSERT

This invention relates to electrical connectors and more particularly to an electrical connector insert within the connector that retains the electrical contacts.

Electrical connectors generally include a plug and a receptacle, each of which has an insert of dielectric material provided with multiple openings within which electrical contacts are releasably retained. Examples of electrical connectors that have rear releasable and rear removable contacts may be found in U.S. Pat. Nos. 3,165,369 issued Jan. 12, 1965 and entitled, "Retention System for Electrical Contacts"; 3,158,424 issued Nov. 24, 1964 and entitled, "Contact Mounting"; 3,824,681 issued July 23, 1974 and entitled, "Method of Providing a Coupling for Electrical Connectors and the Like"; and 3,812,447 issued May 1, 1974 and entitled "Rear Release Contact Retention Assembly". Connectors of this type allow contacts to be removed from the rear of a connector while it is still connected to another connector. An example of another type of electrical connector that has front releasable and front removable contacts as well as rear releasable and rear removable contacts may be found in U.S. Pat. No. 4,082,398 issued Apr. 4, 1978 and entitled, "Electrical Connector with Front and Rear Insertable and Removable Contacts". Finally, an example of an electrical connector of the type having front releasable and rear removable contacts may be found in U.S. Pat. No. 3,221,292 issued Nov. 30, 1960 and entitled, "Electrical Connector".

None of the foregoing connectors provide a connector that can retain a contact that does not have an enlarged middle portion with shoulders.

DISCLOSURE OF THE INVENTION

This invention provides an electrical connector that has a front or rear releasable and removable contact that does not have an enlarged middle portion.

The invention is an electrical connector having an insert comprised of a body of dielectric material having a plurality of passages that are adapted to receive and releasable retain respective electrical contacts that have an annular groove. The connector insert is characterized by a plurality of tubular contact retention towers integral with the insert body and coaxial with respective passages therein, each of the towers having an inwardly projecting shoulder, each tower being resiliently and radially expandable to permit the contact to pass into the tower upon insertion of the contact into a respective passage from the rear of the insert body, the tower contracting when the shoulders projecting from the tower enter the annular groove in the contact to limit forward and rearward movement of the contact in the passage. Each tower is adapted to receive an appropriate tool from the rear or the front of the passage to radially expand the towers whereby the contact is released from either the front or rear of the passage for removal from the insert body.

One advantage of this invention is that it provides the option of releasing a contact from either the front or the rear of a connector depending on the circumstances involved with removing a contact from the rear of the connector.

Another advantage of this invention is that it provides an electrical connector that combines the advantages of a front release and a rear release connector into one connector having removable contacts.

DETAILED DESCRIPTION OF THE INVENTION

FIG. 1 illustrates a partial view of the contact retaining insert of an electrical connector.

FIG. 2 illustrates a partial view of a contact retained by the retention tower shown FIG. 1.

FIG. 3 is a cross sectional view taken along lines III—III of FIG. 2.

FIG. 4 is an alternate embodiment of the contact retention tower shown in FIGS. 1 and 2.

FIG. 5 is a diagrammatic view of an electrical connector incorporating the principles of this invention.

FIG. 6 illustrates front release of a contact for removal from a connector.

FIG. 7 illustrates rear release of a contact for removal from a connector.

Referring now to the drawing, FIG. 1 illustrates a partial view of the components of an electrical connector comprising: an interfacial seal 40; a forward insert 20; a rear contact retaining insert 10 having towers 15; and a rear moisture sealing grommet 30 made from rubber. The forward insert 20 generally includes a plurality of bores 21 which include an enlarged portion 22 for receiving the tower 15 of the rear insert 10. The main body of the rear insert 10 includes a rear face 13 and a forward face 12. A portion of the forward face 12 is in contact with a rear face of the forward insert 20 and the rear face 13 of the insert 10 is in contact with the forward face of the moisture sealing grommet 30. The body of the insert 10 and the retention towers 15 include a passage 11 which extends therethrough. Each of the towers 15 is expandable and is made up of a plurality of resiliently and radially deflectable fingers 14 which are arranged to form the tubular tower 15. Internally of each of the resiliently and radially deflectable fingers 14 there is a shoulder 18, which along with the shoulders 18 in other fingers 14, form an annular shoulder around the inside of the tower 15.

FIG. 2 illustrates how the shoulders 18 inside of each finger 14 forms an annular shoulder inside the retention tower 15 to engage the annular groove 51 of a respective contact 50 thereby retaining the contact in the insert 10.

FIG. 3 is a cross section of FIG. 2 taken along lines III—III and illustrates how the fingers 14 retain a contact 50.

FIG. 4 illustrates an alternate configuration of the tower 15 wherein the free end of each finger 14 terminates in an inwardly projecting shoulder 18. A contact retained by this configuration can only be released from one end of the insert but once released can be but removed from either end.

FIG. 5 illustrates a diagrammatic view of an electrical connector assembly having a male contact 55 and a female contact 50 mounted therein. The connector includes a shell 60 within which are mounted the interfacial seal 40, the inserts 10 and 20, and the grommet 30. The socket type or female contact 50 is retained by the annular groove 51 in the contact 50 which engages the shoulders 18 in the expandable retention tower 15. Similarly, the pin type or male contact 55 is retained by the annular groove 51 and the annular shoulder 18 in the retention tower 15.

FIG. 6 illustrates how a contact 50 is removed from the connector assembly. To release the contact from the front of the connector an appropriate tubular tool 70 is inserted through the rubber interfacial seal 40 and forward insert 20 until it engages the forwardly tapered surface 16 of the contact retention tower 15. Further rearward movement of the contact removal tool 70 deflects the fingers 14 to expand the tower 15 so that the annular shoulders 18 of the tower 15 disengages the annular groove 51 in the contact 50 thereby releasing the contact 50 for removal from the rear of the insert 10 by simply pulling on the wire 80 attached to the contact 50.

FIG. 7 illustrates how à contact 50 may be released from the rear of the connector by inserting an appropriate tool 70 through the sealing grommet 30 and rear insert 20 until it deflects the fingers 14, thereby disengaging the shoulders 18 from the groove 51 in the contact 50.

While a preferred embodiment of the invention has been disclosed it will be apparent to those skilled in the art that changes may be made to the invention as set forth in the appended claims and in some instances certain features of the invention may be used to advantage without corresponding use of other features. For instance, the configuration of the forward insert 20 changes somewhat to accommodate the retention of a pin type contact 55 but both arrangements provide for either front or rear release and removal of a contact. Further, more or less than the number of fingers 14 shown may be used. Acordingly, it is intended that the illustrative and descriptive materials herein be used to illustrate the principles of the invention and not to limit the scope thereof.

Having described the invention what is claimed is:

1. In combination with an electrical connector insert of the type having a body of insulation material having a plurality of passages therethrough from a front face to a rear face and a respective electrical contacts therein which are insertable from the rear, the improvement wherein:

each of said contacts include an annular groove having forwardly and rearwardly facing shoulders perpendicular to the axis of its respective passage; and a plurality of tubular contact retention towers integral with the body and coaxial with the respective passages therein, each of said towers comprised of a plurality of spaced apart axially extending fingers, each finger having an internal annular shoulder on the inside thereof having forwardly and rearwardly facing shoulders perpendicular to the axis of its respective passage, the surfaces on opposite sides of each shoulder tapered radially outwardly and tapering away from the surface of a contact inserted into a passage, each tower being resiliently and radially expandable to permit a respective contact to pass into the tower upon insertion of the contact into a respective passage from the rear of the body, said tower contracting when the shoulders in the tower enter the annular groove in the contact, the walls of the groove engaging the shoulders on the inside of said fingers to limit forward and rearward movement of the contact in the passage, each of said passages and said tapered surfaces on both sides of said shoulders adapted to receive an appropriate tool from the rear or the front of said passage to radially expand the towers and release a contact within said passage, whereby the contact being released from either the front or rear of the passage by an appropriate tool may be removed from the body.

2. The combination as recited in claim 1 wherein the outside surface of each tower is spaced from the wall of a respective bore in said insert.

3. In combination with an electrical connector having rear removable contacts, said connector of the type having: a housing; a plurality of contacts, each contact having a rear portion, a forward mating portion, and a middle portion; and means for releasably mounting said contacts in said housing, the improvement wherein the means for releasably mounting said contacts includes:

an annular groove in the middle portion of each of said contacts said groove having forwardly and rearwardly facing shoulders perpendicular to the axis of its respective passage;

a rear insert having a plurality of bores each having the rear portion of a respective contact therein, the rear insert including a rear base portion and a plurality of tubular contact retention towers, each tower integral with and extending forwardly from said base, coaxial with a respective bore, resiliently and radially expandable and comprised of a plurality of spaced apart axially extending fingers, each finger including on the inside thereof, an annular shoulder having forwardly and rearwardly facing shoulders perpendicular to the axis of its respective passage that engage the annular groove shoulders of a respective contact, the surfaces on opposite sides of said shoulder tapering radially outwardly from said shoulder and away from the surface of said contact; and a forward insert having a plurality of bores each having a portion of the forward portion of a respective contact therein and an enlarged portion having a respective tower therein, each of the bores in the front and rear insert and the tapered surfaces in opposite sides of each shoulder adapted to receive an appropriate tool from the rear or the front whereby a tool may be inserted into a bore in the rear insert or into a bore in the front insert to engage and radially expand a tower until the shoulders in the tower disengage from the groove in the contact, thereby releasing the contact for removal from the rear of the insert.

4. The combination as recited in claim 2 wherein the outside surface of each tower is spaced from the wall of a respective bore in said forward insert.

* * * * *